US009174813B2

(12) United States Patent
Sakata

(10) Patent No.: US 9,174,813 B2
(45) Date of Patent: Nov. 3, 2015

(54) IMAGE FORMING APPARATUS

(71) Applicant: KYOCERA Document Solutions Inc., Osaka (JP)

(72) Inventor: Hiromi Sakata, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 14/555,076

(22) Filed: Nov. 26, 2014

(65) Prior Publication Data

US 2015/0145198 A1 May 28, 2015

(30) Foreign Application Priority Data

Nov. 28, 2013 (JP) ..... 2013-246767

(51) Int. Cl.

| | |
|---|---|
| ***B65H 3/44*** | (2006.01) |
| ***G03G 15/00*** | (2006.01) |
| ***B65H 1/28*** | (2006.01) |
| ***B65H 1/14*** | (2006.01) |
| ***B65H 3/34*** | (2006.01) |
| ***B65H 5/26*** | (2006.01) |
| ***B65H 7/04*** | (2006.01) |
| ***B65H 7/20*** | (2006.01) |

(52) U.S. Cl.

CPC ..... *B65H 3/446* (2013.01); *B65H 1/14* (2013.01); *B65H 1/28* (2013.01); *B65H 3/34* (2013.01); *B65H 3/44* (2013.01); *B65H 5/26* (2013.01); *B65H 7/04* (2013.01); *B65H 7/20* (2013.01); *G03G 15/6508* (2013.01); *G03G 2215/00126* (2013.01)

(58) Field of Classification Search

CPC ..... B65H 3/44; B65H 7/20; B65H 3/446; B65H 2511/412; G03G 15/6508; G03G 2215/00126

See application file for complete search history.

(56) References Cited

U.S. PATENT DOCUMENTS

| | | | | |
|---|---|---|---|---|
| 5,349,422 | A * | 9/1994 | Ohashi | 399/86 |
| 5,534,974 | A * | 7/1996 | Hasegawa | 399/1 |
| 7,151,613 | B1 * | 12/2006 | Ito | 358/1.15 |
| 7,755,794 | B2 * | 7/2010 | Martin et al. | 358/1.6 |
| 7,898,676 | B2 * | 3/2011 | Igarashi et al. | 358/1.14 |
| 8,804,171 | B2 * | 8/2014 | Suzuki | 358/1.15 |
| 2008/0008480 | A1 * | 1/2008 | Momose et al. | 399/23 |
| 2014/0348519 | A1 * | 11/2014 | Osada | 399/16 |

FOREIGN PATENT DOCUMENTS

| | | |
|---|---|---|
| JP | 2004-021049 | 1/2004 |
| JP | 2010-030149 | 2/2010 |

* cited by examiner

*Primary Examiner* — Patrick Cicchino

(57) ABSTRACT

An image forming apparatus includes: a sheet feed section including a plurality of sheet feed cassettes, a designation receiving section configured to receive a designation of a sheet feed cassette for exclusive use from among the plurality of sheet feed cassettes; an exclusive use control section configured to put the sheet feed cassette the designation of which has been received by the designation receiving section into an exclusive use state and, when a predetermined condition is satisfied, switch the sheet feed cassette from the exclusive use state to a non-exclusive use state; and a sheet discharge control section. When the predetermined condition is satisfied, the sheet discharge control section allows the discharge of particular paper sheets remaining in the sheet feed cassette in the exclusive use state before the sheet feed cassette is switched from the exclusive use state to a non-exclusive use state.

7 Claims, 8 Drawing Sheets

IMAGE FORMING APPARATUS

INCORPORATION BY REFERENCE

This application claims priority to Japanese Patent Application No. 2013-246767 filed on Nov. 28, 2013, the entire contents of which are incorporated by reference herein.

BACKGROUND

The present disclosure relates to image forming apparatuses and particularly relates to a technique for putting a particular sheet feed cassette into an exclusive use state.

In an image forming apparatus including a plurality of sheet feed cassettes, each sheet feed cassette can contain a different type of paper sheet. Each user can form an image on a desired type of paper sheet by, upon entry of an image formation job, selecting from the plurality of sheet feed cassettes one to be used for the image formation job. However, in a general image forming apparatus, all of sheet feed cassettes included therein can be used by anyone at will and, therefore, particular paper sheets, for example, expensive exclusive paper sheets, contained in a certain sheet feed cassette and owned by a user may be used by other users.

As a solution to the above, there is known a technique in which in using a particular one of a plurality of sheet feed cassettes, a password is required to be entered and, if the entered password is not valid, the use of the particular sheet feed cassette is not permitted. In this technique, the user can put the particular sheet feed cassette into an exclusive use state and prevent particular paper sheets contained in the particular sheet feed cassette from being used by other users.

There is disclosed another technique in which when a sheet feed cassette put in an exclusive use state has not been used for a predetermined period of time or longer, the exclusive use state is canceled. Since in this technique the exclusive use state of the sheet feed cassette can be canceled when the image forming apparatus has not been used for a long time, the number of usable sheet feed cassettes can be increased.

SUMMARY

A technique improved over the above techniques is proposed herein as one aspect of the present disclosure.

An image forming apparatus according to an aspect of the present disclosure includes a sheet feed section, a conveyance section, an image forming section, a receiving section, an exclusive use control section, a number-of-sheets specifying section, and a sheet discharge control section.

The sheet feed section includes a plurality of sheet feed cassettes.

The conveyance section is configured to convey a paper sheet contained in the sheet feed cassettes.

The image forming section is configured to form an image on the paper sheet conveyed by the conveyance section.

The receiving section is configured to receive an image formation job and a designation of a sheet feed cassette for exclusive use from among the plurality of sheet feed cassettes.

The exclusive use control section is configured to put the sheet feed cassette the designation of which has been received by the receiving section into an exclusive use state, determine whether to permit the image formation job to use the sheet feed cassette in the exclusive use state, and switch the sheet feed cassette from the exclusive use state to a non-exclusive use state when a predetermined condition is satisfied.

The number-of-sheets specifying section is configured to specify the number of particular paper sheets, which are paper sheets to be used in the image formation job permitted to use the sheet feed cassette in the exclusive use state, among paper sheets contained in the sheet feed cassette in the exclusive use state.

The sheet discharge control section is configured to, when the predetermined condition is satisfied and the number of particular paper sheets specified by the number-of-sheets specifying section is more than one, allow the conveyance section to convey and discharge the one or more particular paper sheets remaining in the sheet feed cassette in the exclusive use state before the exclusive use control section switches the sheet feed cassette from the exclusive use state to the non-exclusive use state.

DETAILED DESCRIPTION

Hereinafter, a description will be given of an image forming apparatus according to one embodiment of the present disclosure with reference to the drawings.

Figure 1:
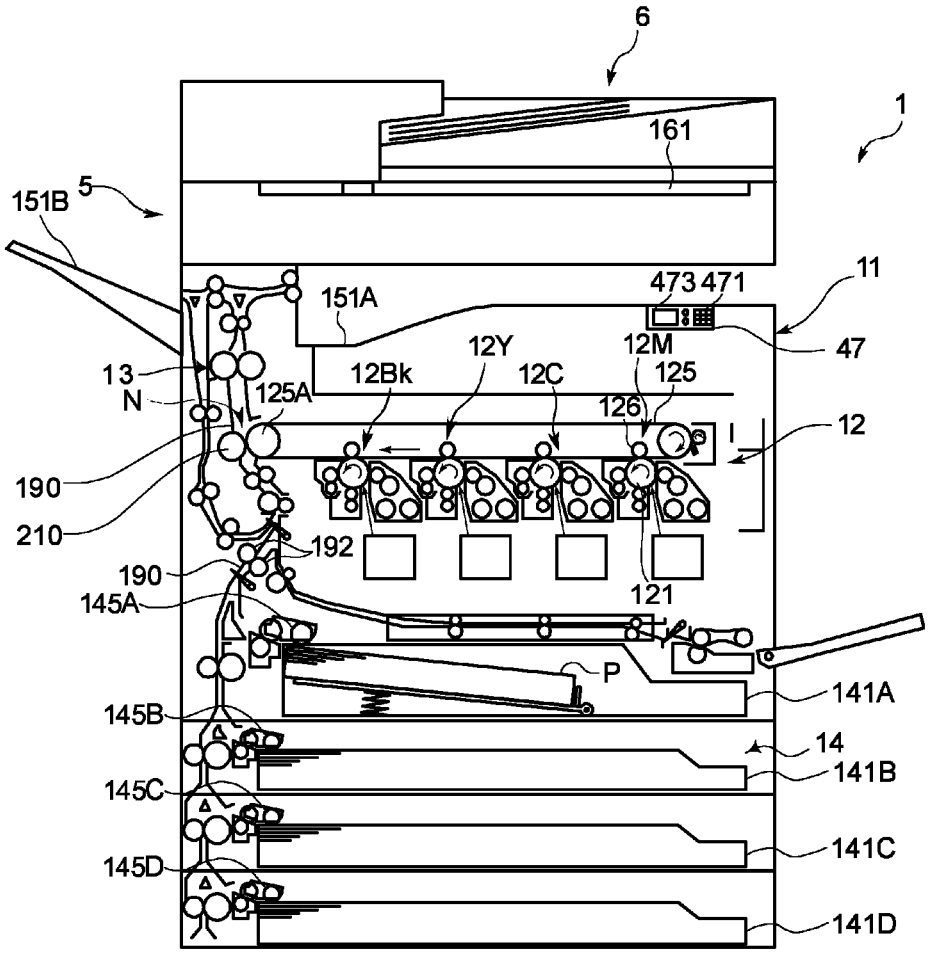
FIG. 1 is a cross-sectional view showing the structure of an image forming apparatus according to one embodiment of the present disclosure.

FIG. 1 is a cross-sectional view showing the structure of an image forming apparatus 1 according to one embodiment of the present disclosure. The image forming apparatus 1 is a multifunction peripheral having multiple functions including, for example, a copy function, a print function, a scan function, and a facsimile function. The image forming apparatus 1 is made up so that an apparatus body 11 thereof includes an image forming section 12, a fixing section 13, a sheet feed section 14, a document feed section 6, a document reading section 5, and so on.

The sheet feed section 14 includes a plurality of sheet feed cassettes 141A to 141D and a manual feed tray. The sheet feed cassettes 141A to 141D contain various types and sizes of paper sheets P. Although will be described in detail later, among the sheet feed cassettes 141A to 141D, the sheet feed cassette 141 for exclusive use contains particular paper sheets (for example, expensive exclusive paper sheets). The particular paper sheets are paper sheets, for the purpose of forming an image in an image formation job permitted to use the sheet feed cassette 141 put in an exclusive use state, contained in the sheet feed cassette 141. Note that the sheet feed cassettes 141A to 141D have the same structure and therefore, unless otherwise distinguished, each sheet feed cassette is indicated at 141 from which "A", "B", and so on are omitted. Likewise, respective pick-up rollers 145A to 145D included in the sheet feed cassettes 141A to 141D have the same structure and therefore, unless otherwise distinguished, each pick-up roller is indicated at 145 from which "A", "B", and so on are omitted.

When the image forming apparatus 1 performs a sheet feed in an image forming operation to be described hereinafter, an operation control section 100 (see FIG. 2) to be described hereinafter drives into rotation the pick-up roller 145 of the sheet feed cassette 141 selected through the operating section 47 by the user and thus allows the pick-up roller 145 to convey a paper sheet P contained in the sheet feed cassette 141 toward a conveyance path 190.

The conveyance path 190 is provided at appropriate points with a plurality of conveyance roller pairs 192. The operation control section 100 is configured to drive the conveyance roller pairs 192 into rotation to allow the conveyance roller pairs 192 to convey the paper sheet P conveyed from the sheet feed cassette 141 onto the conveyance path 190 toward a nip N and the fixing section 13 which will be described hereinafter.

In a document reading operation of the image forming apparatus 1, the document reading section 5 optically reads an image of an original document being fed from the document feed section 6 or an image of an original document placed on an original glass plate 161 to generate image data. The image data generated by the document reading section 5 is stored on an internal HDD, a network-connected computer or the like.

In an image forming operation of the image forming apparatus 1, the image forming section 12 forms a toner image on a paper sheet P serving as a recording medium conveyed from the sheet feed section 14, based on image data generated by the document reading operation, image data received from the network-connected computer, image data stored on the internal HDD or like image data. In the case of multicolor printing, the image forming unit 12M for magenta, the image forming unit 12C for cyan, the image forming unit 12Y for yellow, and the image forming unit 12Bk for black of the image forming section 12 form respective toner images on their respective photosensitive drums 121 through charging, exposure, and developing processes based on respective images of respective different color components constituting the above image data and then allow their respective primary transfer rollers 126 to transfer the toner images to an intermediate transfer belt 125.

The toner images of different colors transferred to the intermediate transfer belt 125 are superposed each other on the intermediate transfer belt 125 by controlling their transfer timings, resulting in a multicolor toner image. A secondary transfer roller 210 transfers the multicolor toner image formed on the outer peripheral surface of the intermediate transfer belt 125, at a nip N between the secondary transfer roller 210 and a drive roller 125A with the intermediate transfer belt 125 in between, to the paper sheet P conveyed from the sheet feed section 14 along the conveyance path 190. Thereafter, the fixing section 13 fixes the toner image on the paper sheet P by the application of heat and pressure. The paper sheet P having a multicolor image fixed thereon by the completion of the fixing process is discharged to a paper output tray 151A or a paper output tray 151B. Although FIG. 1 shows an example where the paper output tray 151A and the paper output tray 151B are provided as destinations of the paper sheet P to be discharged, additional paper output trays may be provided as destinations of the paper sheet P to be discharged. Furthermore, each of the paper output trays 151A, 151B is represented, unless otherwise distinguished, also as the paper output tray 151 from which "A" and "B" are omitted.

Figure 2:
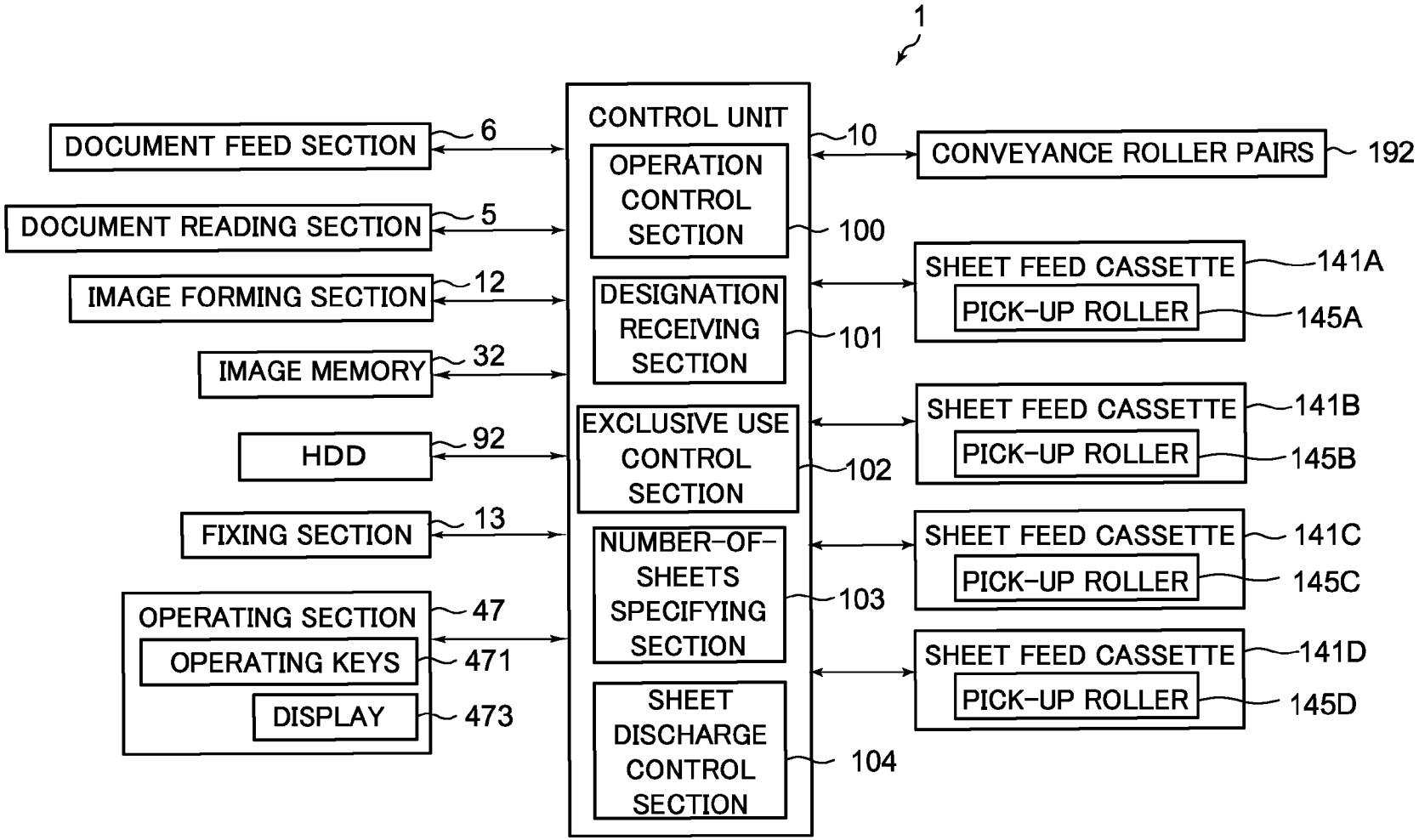
FIG. 2 is a functional block diagram showing an essential internal configuration of the image forming apparatus according to the one embodiment of the present disclosure.

FIG. 2 is a functional block diagram showing an essential internal configuration of the image forming apparatus 1 according to the one embodiment of the present disclosure. The image forming apparatus 1 includes a control unit 10, the document feed section 6, the document reading section 5, the image forming section 12, an image memory 32, an HDD (hard disk drive) 92, the fixing section 13, the operating section 47, the conveyance roller pairs 192, the sheet feed cassettes 141A to 141D, and so on.

The image memory 32 provides a region for temporarily storing data on the document image read by the document reading section 5 and temporarily storing data to be printed by the image forming section 12.

The HDD 92 is a large storage device capable of storing document images and the like read by the document reading section 5.

The operating section 47 includes a plurality of operating keys 471 and a display 473. The display 473 is structured to include an LCD (liquid crystal display) or an OLED (organic light-emitting diode) and configured to display menu screens drawn by a designation receiving section 101 (to be described hereinafter) of the control unit 10 and other screens. The operating keys 471 include, for example, a menu key for calling up a menu screen, arrow keys for moving the focus of a GUI forming the menu screen, a determination key for performing a determination operation on the GUI forming the menu screen, character entry keys for entering characters, numerical entry keys for entering numerical values, and so on and are configured to accept various user's operations on the menu screens displayed on the display 473.

The control unit 10 is composed of a CPU (central processing unit), a RAM, a ROM, a dedicated hardware circuit, and so on and governs the overall operation control of the image forming apparatus 1. The control unit 10 includes the operation control section 100, the designation receiving section 101, an exclusive use control section 102, a number-of-sheets specifying section 103, and a sheet discharge control section 104. The CPU operates in accordance with a program stored, for example, in the RAM or ROM in the control unit 10 or on the HDD 92, so that the control unit 10 functions as each of the above sections thereof.

The operation control section 100 is connected to the document feed section 6, the document reading section 5, the image forming section 12, the image memory 32, the HDD 92, the fixing section 13, the operating section 47, the conveyance roller pairs 192, the sheet feed cassettes 141A to 141D, and so on. The operation control section 100 has the function of controlling the operations of the above sections and components connected thereto. Particularly, the operation control section 100 is configured to drive into rotation the pick-up roller 145 of the sheet feed cassette 141 selected through the operating section 47 by the user and thus allows the pick-up roller 145 to convey a paper sheet P contained in the sheet feed cassette 141 toward the conveyance path 190. Furthermore, the operation control section 100 is configured to drive the conveyance roller pairs 192 into rotation to allow the conveyance roller pairs 192 to convey the paper sheet P fed from the sheet feed cassette 141 onto the conveyance path 190 toward the nip N and the fixing section 13.

Figure 3A:
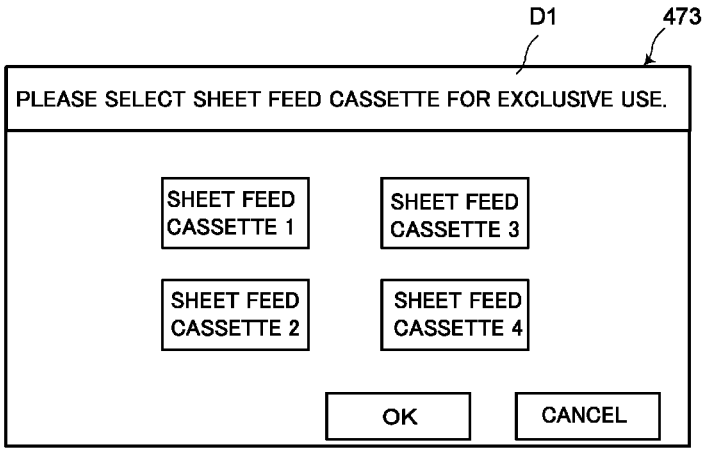
FIG. 3A is a view showing an example of a menu screen through which a designation of a sheet feed cassette for exclusive use is received.

The designation receiving section 101 has the function of allowing the display 473 to display a menu screen and receiving based on the menu screen a designation entered by the user. Specifically, the designation receiving section 101 allows the display 473 to display a menu screen D1 shown in FIG. 3A. Then, the designation receiving section 101 receives a designation of, as a sheet feed cassette for exclusive use, a sheet feed cassette 141 corresponding to a button detected to have been pressed. The sheet feed cassette 141 the designation of which has been received is put into an exclusive use state by the exclusive use control section 102 to be described in detail hereinafter.

Figure 3B:
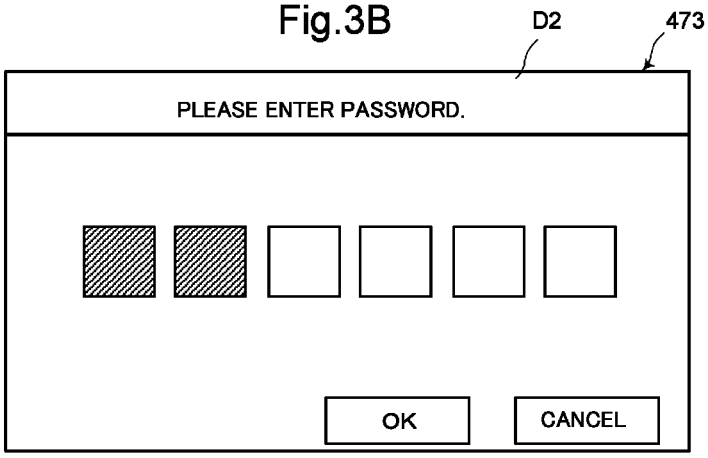
FIG. 3B is a view showing an example of a menu screen through which a password is received.

Furthermore, after receiving the designation of the sheet feed cassette 141 for exclusive use, the designation receiving section 101 allows the display 473 to display a menu screen D2 shown in FIG. 3B. Here, the designation receiving section 101 receives a password (for example, a user code) entered using the operating keys 471. As will hereinafter be described in detail, the received password is used as an authentication means in determining whether to permit the received image formation job to use the sheet feed cassette 141 in the exclusive use state. Although in this embodiment an example is described where a password is used as an authentication means in using the sheet feed cassette 141 in the exclusive use state, an identification number predetermined for each user or identification information stored in an IC card may be used as an authentication means in using the sheet feed cassette 141 in the exclusive use state.

Figure 4A:
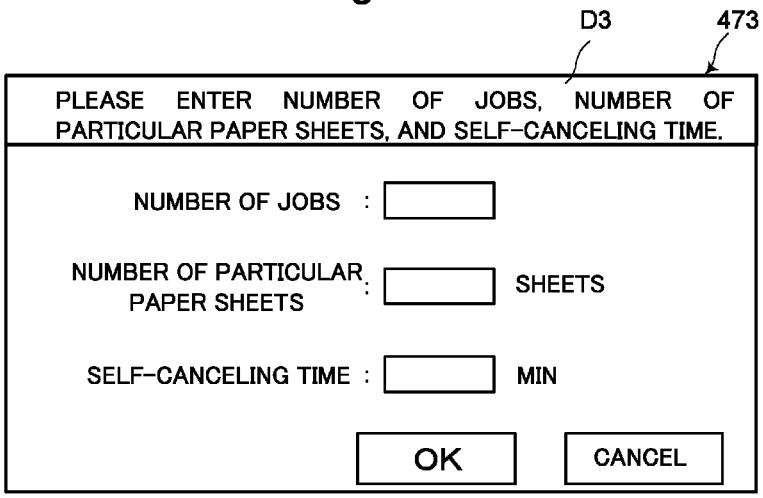
FIG. 4A is a view showing an example of a menu screen through which designations of the number of image formation jobs, the number of particular paper sheets, and the self-canceling time are received.

Moreover, the designation receiving section 101 receives respective designations of the number of image formation jobs to be executed using the sheet feed cassette 141 for exclusive use, the number of particular paper sheets contained in the sheet feed cassette 141 for exclusive use, and the period of time for use in processing for determining whether to cancel the exclusive use state of the sheet feed cassette 141 (i.e., the self-canceling time). More specifically, the designation receiving section 101 allows the display 473 to display a menu screen D3 shown in FIG. 4A and receives respective designations of the number of image formation jobs, the number of particular paper sheets, and the self-canceling time, which are entered using the operating keys 471 while viewing the menu screen D3.

The term "particular paper sheets" used herein are paper sheets previously placed in a sheet feed cassette 141 in an exclusive use state by a user in order to form an image in an image formation job permitted to use the sheet feed cassette 141 in the exclusive use state. The user expects the number of particular paper sheets (for example, 50 sheets) for use in forming an image with the sheet feed cassette 141 put in an exclusive use state and places only the expected number of particular paper sheets into the sheet feed cassette 141. Alternatively, the user places the expected number of particular paper sheets into the sheet feed cassette 141 by placing them on normal paper sheets already contained in the sheet feed cassette 141.

Figure 4B:
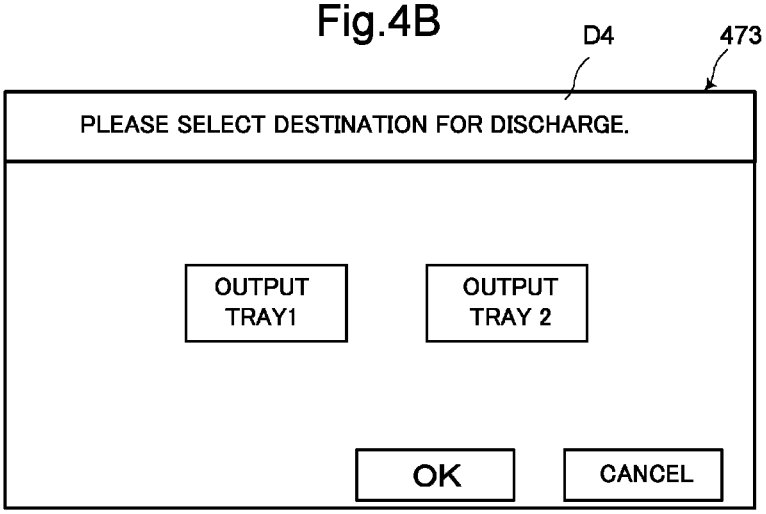
FIG. 4B is a view showing an example of a menu screen through which a destination of the particular paper sheets to be discharged is received.

Furthermore, the designation receiving section 101 allows the display 473 to display a menu screen D4 shown in FIG. 4B. Then, the designation receiving section 101 receives a designation of, as a destination of the paper sheets P to be discharged, a paper output tray 151 corresponding to a button detected to have been pressed. The operation control section 100 allows the particular paper sheets, which have been conveyed from the sheet feed cassette 141 in the exclusive use state and on each of which an image has been formed by the image forming section 12, to be discharged to the paper output tray 151 the designation of which has been received. Moreover, as will hereinafter be described in detail, in the image forming apparatus 1 according to this embodiment, the remaining particular paper sheets in the sheet feed cassette 141 are discharged before the exclusive use state of the sheet feed cassette 141 is canceled. The paper output tray 151 the designation of which has been received by the designation receiving section 101 may also be used as a destination for which the remaining particular paper sheets in the sheet feed cassette 141 is to be discharged. In other words, the paper output tray 151 designated as a destination for sheet discharge may be exclusively used as a destination for discharge of the particular paper sheets conveyed from the sheet feed cassette 141 in the exclusive use state and having images formed thereon by the image forming section 12 or may be exclusively used as a destination for discharge of the particular paper sheets remaining in the sheet feed cassette 141.

The above setting values received by the designation receiving section 101 are stored on the HDD 92 or in the RAM or ROM in the control unit 10.

Moreover, the designation receiving section 101 is configured to conduct authentication with the use of the aforementioned password or the like entered using the operating section 47. After the designation of the sheet feed cassette 141 is entered using the operating section 47 or the like to designate the sheet feed cassette 141 for use, the designation receiving section 101 receives an image formation job formed of image data in which the above password and information designating the sheet feed cassette 141 for use are added to the image data generated by reading of an image of an original document in the document reading section 5. The designation receiving section 101 also receives an image formation job formed of image data in which the above password and information designating the sheet feed cassette 141 for use are added to the image data received from the network-connected computer.

The number-of-sheets specifying section 103 has the function of specifying the number of remaining particular paper sheets in the sheet feed cassette 141 in the exclusive use state. Specifically, the number-of-sheets specifying section 103 specifies the number of remaining particular paper sheets in the sheet feed cassette 141 in the exclusive use state by subtracting the number of particular paper sheets on each of which an image has been formed by the image forming section 12 in an image formation job permitted to use the sheet feed cassette 141 in the exclusive use state from the number of particular paper sheets the designation of which has been received by the designation receiving section 101.

Alternatively, the number-of-sheets specifying section 103 may detect the number of particular paper sheets with a sensor or the like provided in the sheet feed cassette 141 and specify the number of remaining particular paper sheets in the sheet feed cassette 141 based on a detection signal output from the sensor or the like.

The exclusive use control section 102 is configured to put the sheet feed cassette 141 the designation of which has been received by the designation receiving section 101 into an exclusive use state and determine whether to permit an image formation job received by the designation receiving section 101 to use the sheet feed cassette 141 in the exclusive use state.

The term "exclusive use state" used herein refers to a state where only an image formation job authenticated based on a password is permitted to use the sheet feed cassette 141 and any image formation job not authenticated based on a password is not permitted to use the sheet feed cassette 141. In receiving an image formation job having selected the sheet feed cassette 141 in the exclusive use state (an image formation job in which information added to the image data and designating the sheet feed cassette 141 for use designates the sheet feed cassette 141 in the exclusive use state), the exclusive use control section 102 compares the password added to the image date of the received image formation job with a password previously received by the designation receiving section 101 and stored on the HDD 92 or the like to determine whether or not both the passwords are identical. If the passwords are identical, the exclusive use control section 102 permits the entered image formation job to use the sheet feed cassette 141 in the exclusive use state. On the other hand, if the passwords are not identical, the exclusive use control section 102 does not permit the entered image formation job to use the sheet feed cassette 141 in the exclusive use state.

Furthermore, the exclusive use control section 102 is configured to switch the sheet feed cassette 141 from the exclusive use state to a non-exclusive use state when a predetermined condition is satisfied. Specifically, the exclusive use control section 102 switches the sheet feed cassette 141 in the exclusive use state to a non-exclusive use state when the number of image formation jobs permitted to use the sheet feed cassette 141 in the exclusive use state and executed reaches the number of jobs the designation of which has been previously received by the designation receiving section 101 and stored on the HDD 92 or the like.

Moreover, the exclusive use control section 102 includes a counter and is configured so that a counting operation of the counter is started at the point of time when the exclusive use state of the sheet feed cassette 141 is started. Then, when the time counted by the counter is over the aforementioned self-canceling time before the point of time when an image formation job permitted to use the sheet feed cassette 141 in the exclusive use state is started, the exclusive use control section 102 switches the sheet feed cassette 141 in the exclusive use state to a non-exclusive use state. At the point of time when the image formation job is started, the time counted by the counter is reset. During the execution of the image formation job concerned, the counting operation of the counter is stopped.

Furthermore, the exclusive use control section 102 starts the counting operation of the counter at the point of time when the image formation job permitted to use the sheet feed cassette 141 in the exclusive use state is completed. Then, when the counted time is over the aforementioned self-canceling time before the point of time when a next image formation job permitted to use the sheet feed cassette 141 in the exclusive use state is started, the exclusive use control section 102 switches the sheet feed cassette 141 in the exclusive use state to a non-exclusive use state. At the point of time when the next image formation job is started, the time counted by the counter is reset. During the execution of the image formation job concerned, the counting operation of the counter is stopped.

On the other hand, when an image formation job not using the sheet feed cassette 141 in the exclusive use state is interrupted and executed between the end of an image formation job permitted to use the sheet feed cassette 141 in the exclusive use state and the start of a next image formation job permitted to use the sheet feed cassette 141 in the exclusive use state, the exclusive use control section 102 stops the counting operation of the counter while the interrupt image formation job is executed. Then, after the end of the interrupt image formation job, the exclusive use control section 102 restarts the counting operation of the counter.

As just described, the exclusive use state of the sheet feed cassette 141 is canceled when the predetermined condition is satisfied even if no command to cancel the exclusive use state of the sheet feed cassette 141 is given from the user. Therefore, it can be prevented that a situation occurs where because the user forgets to cancel the exclusive use state of the sheet feed cassette 141, other users cannot use the sheet feed cassette 141 for a long time.

Figure 5:
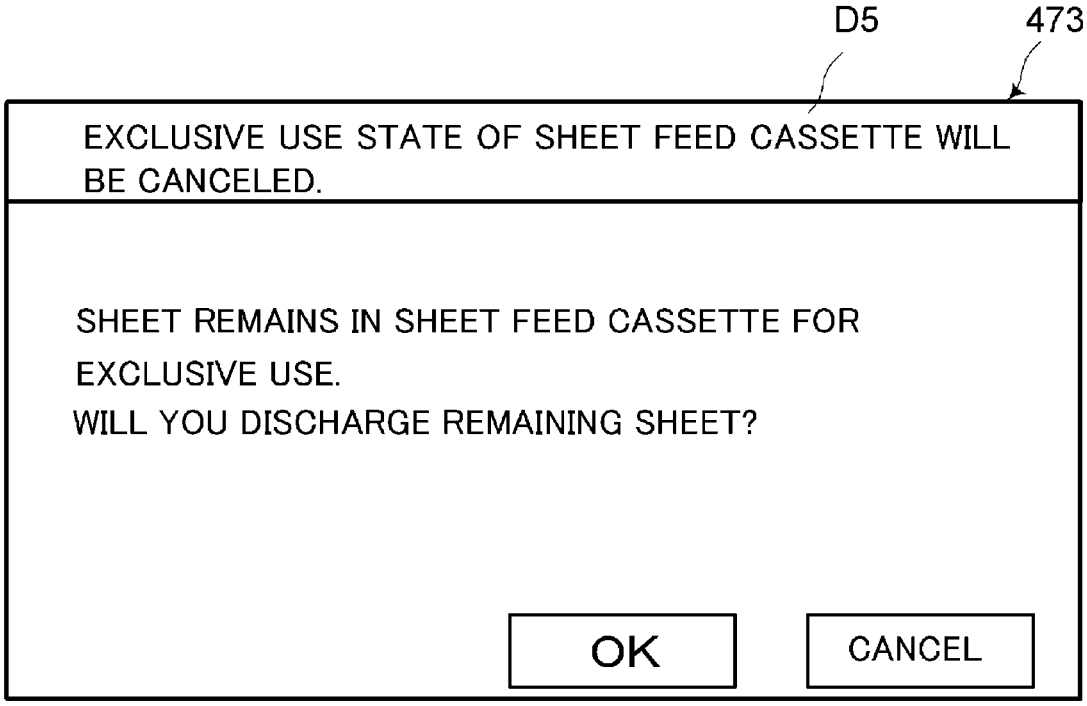
FIG. 5 is a view showing an example of a menu screen displaying a message of whether to discharge the particular paper sheets remaining in the sheet feed cassette in an exclusive use state.

The sheet discharge control section 104 is configured to allow the pick-up roller 145 and the conveyance roller pairs 192 (conveyance section) to convey and discharge the particular paper sheets remaining in the sheet feed cassette 141 in the exclusive use state before the exclusive use control section 102 switches the sheet feed cassette 141 in the exclusive use state to a non-exclusive use state. Specifically, when the predetermined condition is satisfied, the sheet discharge control section 104 is informed of the number of remaining particular paper sheets in the sheet feed cassette 141 in the exclusive use state, which has been specified by the number-of-sheets specifying section 103. If at this time one or more particular paper sheets remain in the sheet feed cassette 141 in the an exclusive use state, the sheet discharge control section 104 notifies the user of a message that the exclusive use state of the sheet feed cassette 141 will be canceled and a message of whether to discharge the particular paper sheets remaining in the sheet feed cassette 141 in the exclusive use state, for example, by allowing the display 473 to display a menu screen D5 shown in FIG. 5. Thereafter, the sheet discharge control section 104 controls the pick-up roller 145 and the conveyance roller pairs 192 (conveyance section) to allow them to discharge the particular paper sheets remaining in the sheet feed cassette 141 in the exclusive use state to the destination received by the designation receiving section 101. In doing so, the sheet discharge control section 104 does not allow the image forming operation for forming a toner image on a paper sheet P by operating the image forming section 12, the fixing section 13, and so on, but allows only the operation for conveying the particular paper sheets.

Since as described above the sheet discharge control section 104 allows one or more particular paper sheets remaining in the sheet feed cassette 141 in the exclusive use state to be discharged before the sheet feed cassette 141 is switched from the exclusive use state to a non-exclusive use state, it can be avoided that after the exclusive use state of the sheet feed cassette 141 is canceled, the particular paper sheets remaining in the sheet feed cassette 141 are used by other users. Furthermore, the sheet discharge control section 104 is informed of the number of remaining particular paper sheets in the sheet feed cassette 141 in the exclusive use state, which has been specified by the number-of-sheets specifying section 103, and allows the paper sheets to be discharged to the number of which the sheet discharge control section 104 has been informed. Therefore, only the particular paper sheets remaining in the sheet feed cassette 141 can be discharged and the paper sheets other than the particular paper sheets can be left contained in the sheet feed cassette 141. This is effective when particular paper sheets are contained in the sheet feed cassette 141 by placing them on normal paper sheets already contained in the sheet feed cassette 141.

Moreover, the sheet discharge control section 104 allows an image formation job permitted to use the sheet feed cassette 141 in the exclusive use state to exclusively use the destination for sheet discharge received by the designation receiving section 101 and stored on the HDD 92 or the like. In other words, in an image formation job permitted to use the sheet feed cassette 141 in the exclusive use state, the sheet discharge control section 104 allows particular paper sheets to be discharged to a different destination from a destination for which paper sheets P having an image formed thereon in an image formation job not permitted to use the sheet feed cassette 141 in the exclusive use state are discharged. Thus, the possibility is reduced that particular paper sheets (for example, expensive exclusive paper sheets) having remained in the sheet feed cassette 141 in the exclusive use state and then discharged are used by others.

Figure 6:
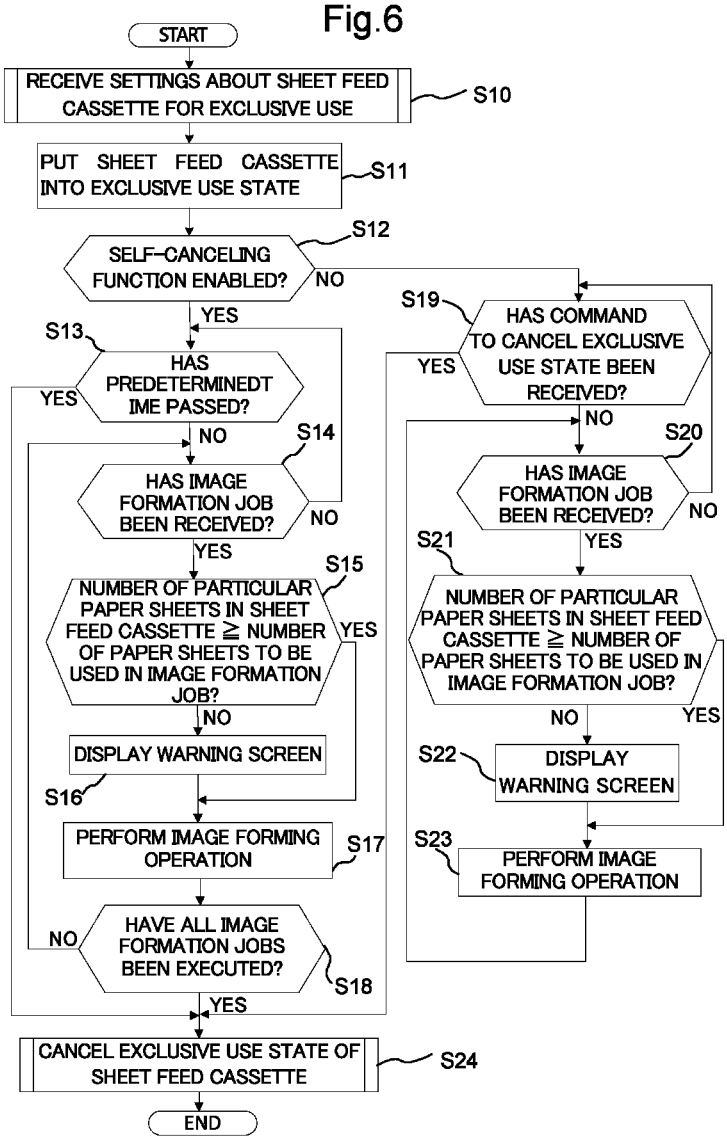
FIG. 6 is a flowchart showing a general processing flow of the image forming apparatus according to the one embodiment of the present disclosure.
Figure 7:
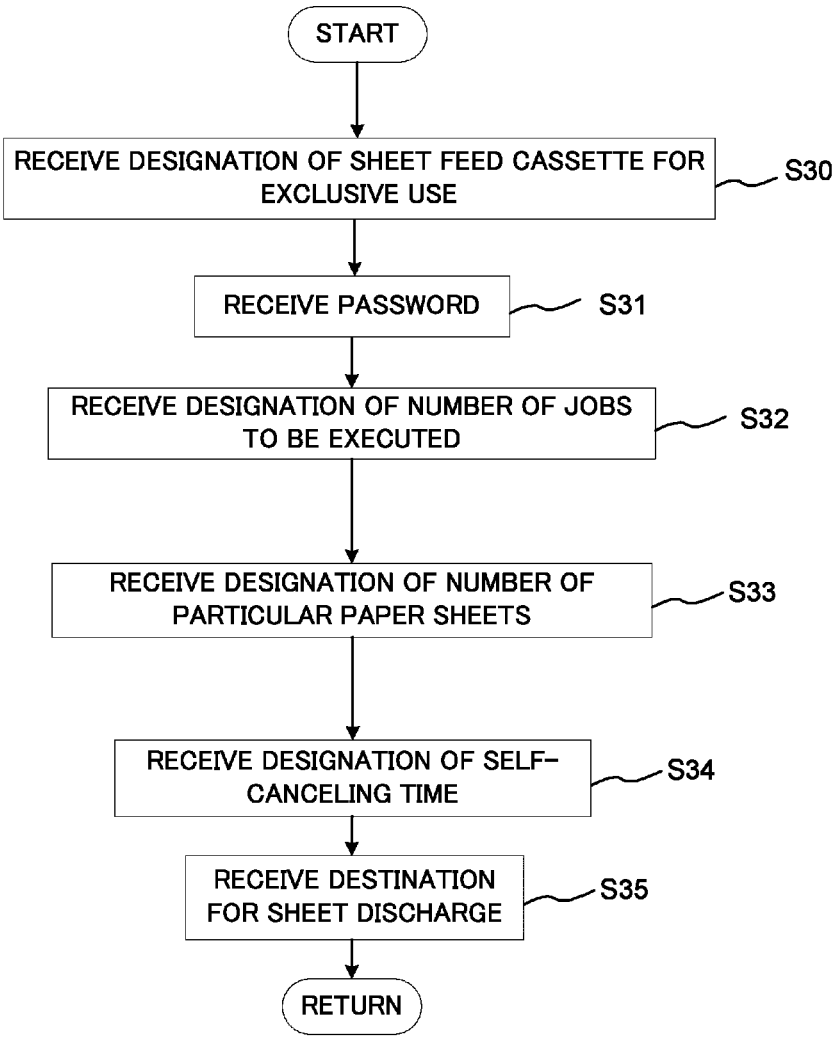
FIG. 7 is a flowchart showing a flow of processing for receiving settings about the sheet feed cassette for exclusive use in the image forming apparatus according to the one embodiment of the present disclosure.
Figure 8:
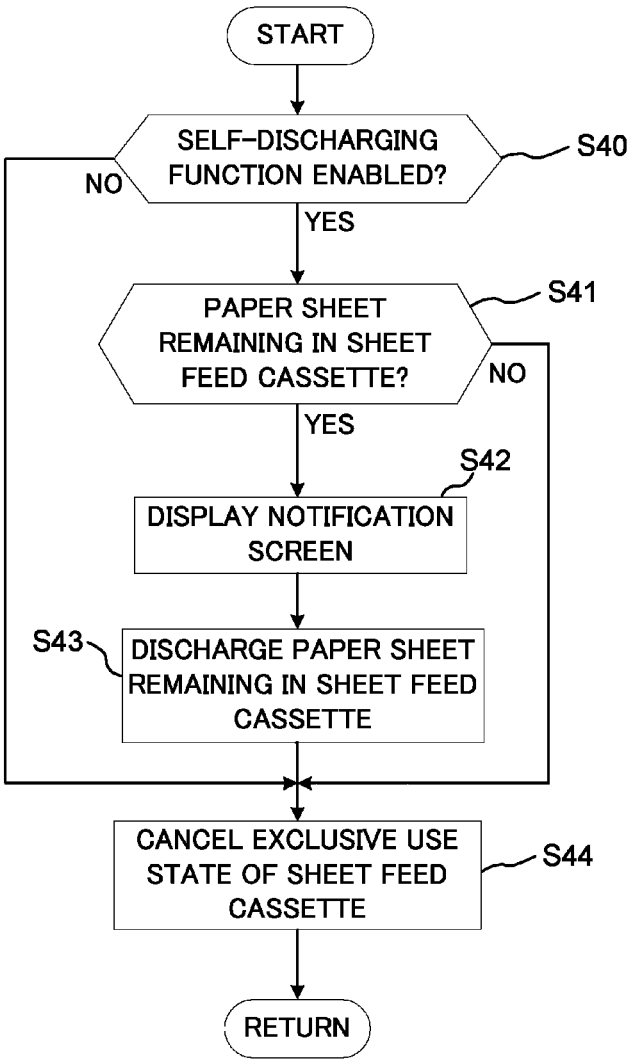
FIG. 8 is a flowchart showing a flow of processing for canceling the exclusive use state of the sheet feed cassette in the image forming apparatus according to the one embodiment of the present disclosure.

Next, a description will be given of the operation of the image forming apparatus 1 having the above configuration. FIG. 6 is a flowchart showing a general processing flow of the image forming apparatus 1. FIG. 7 is a flowchart showing a flow of processing for receiving settings about a sheet feed cassette 141 for exclusive use in the image forming apparatus 1. FIG. 8 is a flowchart showing a flow of processing for canceling the exclusive use state of the sheet feed cassette 141 in the image forming apparatus 1.

As shown in FIG. 6, the designation receiving section 101 of the image forming apparatus 1 receives settings about an sheet feed cassette 141 for exclusive use (step S10). The details of this processing will be described below with reference to FIG. 7.

The designation receiving section 101 allows the display 473 to display the menu screen D1 and receives a designation of a sheet feed cassette 141 for exclusive use based on a user's designation entered using the operating section 47 (step S30).

The designation receiving section 101 allows the display 473 to display the menu screen D2 and receives, based on a user's designation entered using the operating section 47, a password to be used as an authentication means in using the sheet feed cassette 141 in an exclusive use state (step S31).

The designation receiving section 101 allows the display 473 to display the menu screen D3 and receives, based on user's designations entered using the operating section 47, respective designations of the number of image formation jobs to be executed using the sheet feed cassette 141 for exclusive use, the number of particular paper sheets contained in the sheet feed cassette 141 for exclusive use, and the self-canceling time (steps S32 to S34).

The designation receiving section 101 allows the display 473 to display the menu screen D4 and receives, based on a user's designation entered using the operating section 47, a destination for which the particular paper sheets remaining in the sheet feed cassette 141 are to be discharged (step S35).

Referring back to FIG. 6, after the processing in step S10, the exclusive use control section 102 puts the sheet feed cassette 141 the designation of which has been received in step S30 into an exclusive use state (step S11).

After putting the sheet feed cassette 141 into an exclusive use state, the exclusive use control section 102 determines whether or not a self-canceling function is enabled (step S12). This self-canceling function is the function of automatically canceling the exclusive use state of the sheet feed cassette 141 and operates when the self-canceling time is entered based on the menu screen D3 shown in FIG. 4A or when the self-canceling function is separately set to be enabled.

If the self-canceling function is enabled (YES in step S12), the image forming apparatus 1, as shown in steps S13 to S18, performs an image forming operation using the sheet feed cassette 141 in the exclusive use state and, when the predetermined condition is satisfied, cancels the exclusive use state of the sheet feed cassette 141.

The exclusive use control section 102 determines whether or not a predetermined time has passed since the start of the exclusive use state of the sheet feed cassette 141 (step S13). In this case, the predetermined time is the self-canceling time the designation of which has been received in step S34.

If the predetermined time has passed (YES in step S13), the processing for canceling the exclusive use state of the sheet feed cassette 141 is performed (step S24). The details of this processing will be described hereinafter.

If the predetermined time has not passed (NO in step S13), the exclusive use control section 102 determines whether or not an image formation job permitted to use the sheet feed cassette 141 in the exclusive use state has been received (step S14).

If such an image formation job has not been received (NO in step S14), the process goes back to the processing in step S13, in which the exclusive use control section 102 determines whether or not the predetermined time has passed. To sum up, the exclusive use control section 102 determines whether or not the predetermined time has passed during the period from the start of an exclusive use state of the sheet feed cassette 141 to the start of an image formation job permitted to use the sheet feed cassette 141 in the exclusive use state and then, when the predetermined time has passed, performs the processing for switching the sheet feed cassette 141 in the exclusive use state to a non-exclusive use state.

If an image formation job permitted to use the sheet feed cassette 141 in the exclusive use state has been received (YES in step S14), the exclusive use control section 102 is informed of the number of remaining particular paper sheets in the sheet feed cassette 141, which has been specified by the number-of-sheets specifying section 103, and determines whether or not the number is equal to or greater than the number of paper sheets to be used in the image formation job (step S15).

If the number of remaining particular paper sheets is neither equal to nor greater than the number of paper sheets to be used in the image formation job (NO in step S15), the exclusive use control section 102 allows the display 473 to display a menu screen (warning screen) indicating a shortage of particular paper sheets remaining in the sheet feed cassette 141 in the exclusive use state (step S16). Alternatively, the exclusive use control section 102 may allow the display 473 to display the warning screen with a timing when the number of remaining particular paper sheets in the sheet feed cassette 141 reaches zero during the execution of the image formation job.

In the above processing in step S16, the display 473 serves as a notifying section notifying the user of a warning and the exclusive use control section 102 serves as a notification control section controlling the notifying operation of the notifying section. If the image forming apparatus 1 is equipped with a speaker, the exclusive use control section 102 may notify the user of a warning by allowing the speaker to emit a predetermined warning beep.

Thereafter, the exclusive use control section 102 performs image formation processing based on the image formation job (step S17). Then, the exclusive use control section 102 determines whether or not image formation jobs have been executed up to a number equal to the number of jobs to be executed the designation of which has been received in step S32 (step S18).

If image formation jobs have been executed up to a number equal to the number of jobs to be executed (YES in step S18), the processing for canceling the exclusive use state of the sheet feed cassette 141 is performed (step S24).

If image formation jobs have not been executed up to a number equal to the number of jobs to be executed (NO in step S18), the process goes back to the processing in step S14, in which the exclusive use control section 102 determines whether or not an image formation job permitted to use the sheet feed cassette 141 in the exclusive use state has been received. If such an image formation job has not been received, the process further goes back to the processing in step S13, in which the exclusive use control section 102 determines whether or not the predetermined time has passed. To sum up, the exclusive use control section 102 determines whether or not the predetermined time has passed during the period from the end of an image formation job permitted to use the sheet feed cassette 141 in the exclusive use state to the start of a next image formation job of the same type and then, when the predetermined time has passed, performs the processing for switching the sheet feed cassette 141 in the exclusive use state to a non-exclusive use state.

If the self-canceling function is disabled (NO in step S12), the exclusive use control section 102 determines whether or not a command to cancel the exclusive use state has been received (step S19). If the self-canceling function is not set to be enabled, a command to cancel the exclusive use state will be separately entered in due time. Alternatively, when no command to cancel the exclusive use state is entered, the exclusive use control section 102 may cancel the exclusive use state of the sheet feed cassette 141 with a predetermined timing.

If a command to cancel the exclusive use state has been received (YES in step S19), the exclusive use control section 102 performs the processing for canceling the exclusive use state of the sheet feed cassette 141 (step S24). If no command to cancel the exclusive use state has been received (NO in step S19), the exclusive use control section 102 performs image formation processing shown in steps S20 to S23. This series of processing elements are the same as those previously described in steps S14 to S17 and therefore further description thereof is considered unnecessary.

Next, a description will be given of the processing for canceling the exclusive use state of the sheet feed cassette 141 in step S24 with reference to FIG. 8.

The sheet discharge control section 104 determines whether or not a self-discharging function is enabled (step S40). This self-discharging function is the function of automatically discharging particular paper sheets remaining in the sheet feed cassette 141 and whether to enable this function is previously set. Alternatively, this function may be automatically enabled when the sheet feed cassette 141 is put into an exclusive use state.

If the self-discharging function is disabled (NO in step S40), the exclusive use control section 102 cancels the exclusive use state of the sheet feed cassette 141 being in the exclusive use state (step S44). On the other hand, if the self-discharging function is enabled (YES in step S40), the sheet discharge control section 104 is informed of the number of remaining particular paper sheets in the sheet feed cassette 141, which has been specified by the number-of-sheets specifying section 103, and determines whether or not any particular paper sheet remains in the sheet feed cassette 141 in the exclusive use state (step S41).

If no particular paper sheet remains in the sheet feed cassette 141 in the exclusive use state (NO in step S41), the sheet discharge control section 104 cancels the exclusive use state of the sheet feed cassette 141 being in the exclusive use state (step S44).

If any particular paper sheet remains in the sheet feed cassette 141 in the exclusive use state (YES in step S41), the sheet discharge control section 104 allows the display 473 to display the menu screen D5 (notification screen) (step S42).

Then, the sheet discharge control section 104 controls the pick-up roller 145 and the conveyance roller pairs 192 (conveyance section) to allow them to discharge the particular paper sheets remaining in the sheet feed cassette 141 in the exclusive use state (step S43). In doing so, the sheet discharge control section 104 allows the pick-up roller 145 and the conveyance roller pairs 192 to discharge the particular paper sheets to the destination received in step S35. After the discharge of the particular paper sheets, the exclusive use control section 102 cancels the exclusive use state of the sheet feed cassette 141 being in the exclusive use state (step S44).

When the designation receiving section 100 receives, as an image formation job, image data to which no information designating the sheet feed cassette 141 for use is added, it allows the screen for selecting which to use out of the sheet feed cassettes 141 to be displayed. Then, when the sheet feed cassette 141 in the exclusive use state is selected, the designation receiving section 100 allows the screen for entering a password to be displayed and receives a password. Here, when the entered password is identical with the password previously received by the designation receiving section 101 and stored on the HDD 92 or the like, the exclusive use control section 102 determines the received image formation job is one permitted to use the sheet feed cassette 141 in the exclusive use state, so that the sheet feed cassette 141 in the exclusive use state is permitted to be used for the image formation job.

In the known general techniques described previously, after the exclusive use state of the sheet feed cassette is canceled, particular paper sheets remaining in the sheet feed cassette, which was put into the exclusive use state before, may be used by other users. Unlike the above techniques, in the image forming apparatus 1 according to the one embodiment of the present disclosure, the sheet discharge control section 104 enables the discharge of all of particular paper sheets remaining in the sheet feed cassette 141 in an exclusive use state before the exclusive use control section 102 switches the sheet feed cassette 141 from the exclusive use state to a non-exclusive use state. Therefore, the situation can be avoided where the user forgets to pick up the particular paper sheets (for example, expensive exclusive paper sheets) remaining in the sheet feed cassette 141 in the exclusive use state and the remaining particular paper sheets are used by other users.

The present disclosure is not limited to the configuration of the above embodiment and can be modified in various ways. The structure and processing shown in the above embodiment with reference to FIGS. 1 to 8 are merely illustrative of the present disclosure and the present disclosure is not intended to be limited to the above structure and processing.

For example, after the paper sheets P remaining in the sheet feed cassette 141 are discharged, the exclusive use control section 102 may allow the display 473 to display a menu screen indicating the destination of the paper sheets P discharged and a message that the remaining paper sheets P in the sheet feed cassette 141 have been discharged.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming apparatus comprising:

a sheet feed section including a plurality of sheet feed cassettes;

a conveyance section configured to convey a paper sheet contained in the sheet feed cassettes;

an image forming section configured to form an image on the paper sheet conveyed by the conveyance section;

a receiving section configured to receive an image formation job and a designation of a sheet feed cassette for exclusive use from among the plurality of sheet feed cassettes;

an exclusive use control section configured to put the sheet feed cassette the designation of which has been received by the receiving section into an exclusive use state, determine whether to permit the image formation job to use the sheet feed cassette in the exclusive use state, and switch the sheet feed cassette from the exclusive use state to a non-exclusive use state when a predetermined condition is satisfied;

a number-of-sheets specifying section configured to specify the number of particular paper sheets, which are paper sheets to be used in the image formation job permitted to use the sheet feed cassette in the exclusive use state, among paper sheets contained in the sheet feed cassette in the exclusive use state; and a sheet discharge control section configured to, when the predetermined condition is satisfied and the number of particular paper sheets specified by the number-of-sheets specifying section is more than one, allow the conveyance section to convey and discharge the one or more particular paper sheets remaining in the sheet feed cassette in the exclusive use state before the exclusive use control section switches the sheet feed cassette from the exclusive use state to the non-exclusive use state.

2. The image forming apparatus according to claim 1, further comprising a plurality of destinations of the paper sheets to be discharged, wherein the sheet discharge control section is configured to allow the conveyance section to discharge the one or more particular paper sheets remaining in the sheet feed cassette in the exclusive use state to the destination different from the destination for which the paper sheet having an image formed thereon in an image formation job not permitted to use the sheet feed cassette in the exclusive use state is discharged.

3. The image forming apparatus according to claim 1, wherein the number-of-sheets specifying section is configured to be informed of the number of particular paper sheets contained in the sheet feed cassette for exclusive use and specify the number of remaining particular paper sheets in the sheet feed cassette in the exclusive use state by subtracting the number of particular paper sheets on each of which an image has been formed by the image forming section in the image formation job permitted to use the sheet feed cassette in the exclusive use state from the number of particular paper sheets of which the number-of-sheets specifying section is informed.

4. The image forming apparatus according to claim 3, further comprising a notifying section and a notification control section configured to control a notifying operation of the notifying section, wherein the notification control section allows the notifying section to notify a user of a predetermined warning when the number of particular paper sheets contained in the sheet feed cassette in the exclusive use state is less than the number of paper sheets to be used in the image formation job permitted to use the sheet feed cassette in the exclusive use state.

5. The image forming apparatus according to claim 1, wherein the exclusive use control section includes a counter and is configured to switch the sheet feed cassette from the exclusive use state to a non-exclusive use state when the time counted from the start of the exclusive use state of the sheet feed cassette is over a predetermined time before the start of the image formation job permitted to use the sheet feed cassette in the exclusive use state or when the time counted from the end of the image formation job permitted to use the sheet feed cassette in the exclusive use state is over a predetermined time before the start of a next image formation job permitted to use the sheet feed cassette in the exclusive use state.

6. The image forming apparatus according to claim 5, wherein when an image formation job not using the sheet feed cassette in the exclusive use state is interrupted and executed between the end of the image formation job permitted to use the sheet feed cassette in the exclusive use state and the start of a next image formation job permitted to use the sheet feed cassette in the exclusive use state, the exclusive use control section stops the time count of the counter while the interrupt image formation job is executed.

7. The image forming apparatus according to claim 1, wherein the receiving section is configured to further receive a designation of the maximum number of image formation jobs to be executed using the sheet feed cassette in the exclusive use state, and the exclusive use control section switches the sheet feed cassette in the exclusive use state to a non-exclusive use state when the number of image formation jobs executed using the sheet feed cassette in the exclusive use state reaches the maximum number of image formation jobs to be executed the designation of which has been received by the receiving section.

* * * * *